US010926923B2

(12) United States Patent
Berroa Garcia

(10) Patent No.: US 10,926,923 B2
(45) Date of Patent: Feb. 23, 2021

(54) CLOSURE DEVICE WITH OPENING INDICATOR

(71) Applicant: BETAPACK, S.A.U., Irun (ES)

(72) Inventor: Javier Berroa Garcia, Irun (ES)

(73) Assignee: BETAPACK, S.A.U., Irun (ES)

( * ) Notice: Subject to any disclaimer, the term of this patent is extended or adjusted under 35 U.S.C. 154(b) by 13 days.

(21) Appl. No.: 16/093,618

(22) PCT Filed: Apr. 13, 2016

(86) PCT No.: PCT/ES2016/070254
§ 371 (c)(1),
(2) Date: Oct. 12, 2018

(87) PCT Pub. No.: WO2017/178665
PCT Pub. Date: Oct. 19, 2017

(65) Prior Publication Data

US 2019/0119008 A1 Apr. 25, 2019

(51) Int. Cl.
*B65D 41/32* (2006.01)
*B65D 55/02* (2006.01)
*B65D 47/08* (2006.01)

(52) U.S. Cl.
CPC ..... *B65D 41/32* (2013.01); *B65D 47/0804* (2013.01); *B65D 55/02* (2013.01); *B65D 2401/15* (2020.05)

(58) Field of Classification Search
CPC .... B65D 41/32; B65D 55/02; B65D 47/0804; B65D 2101/0023; B65D 55/024; B65D 47/0885; B65D 2101/0069
USPC ..... 215/237; 222/556
See application file for complete search history.

(56) References Cited

U.S. PATENT DOCUMENTS 3,737,064 A * 6/1973 Patel ..... B65D 41/3442 215/252
4,941,592 A 7/1990 Kitterman
5,219,084 A * 6/1993 King ..... B65D 1/02 215/220
2008/0169261 A1* 7/2008 Druitt ..... B65D 47/0809 215/237
2012/0067922 A1* 3/2012 Benoit-Gonin .... B65D 47/2031 222/153.06
2014/0138380 A1* 5/2014 Fox ..... B65D 41/3457 220/214

(Continued)

FOREIGN PATENT DOCUMENTS

EP 1892194 A1 9/2007
WO 2009056829 A1 5/2009

(Continued)

*Primary Examiner* — James N Smalley
(74) *Attorney, Agent, or Firm* — John A. Fortkort; Fortkort & Houston PC

(57) ABSTRACT

Closure device comprising a base (100) and a lid (200) articulated by a hinge (205) comprising at least one opening indicator (207) allowing the user to know that a container has been opened at least once. Prior to the first opening, the opening indicator (207) is attached to the lid (200) by at least one separable connector (208), said separable connector (208) being broken on the opening of the container. The base (100) further comprises at least one housing (111) that receives the opening indicator (207) after its separation and shows it to the user through at least one window (112).

16 Claims, 10 Drawing Sheets

(56) References Cited

U.S. PATENT DOCUMENTS

| | | | | |
|---|---|---|---|---|
| 2015/0175318 | A1* | 6/2015 | Pellerin ..... | B65D 43/0235<br>215/230 |

FOREIGN PATENT DOCUMENTS

| | | | |
|---|---|---|---|
| WO | 2009056829 | A1 | 7/2009 |
| WO | 2010112801 | A1 | 7/2010 |
| WO | 2010112801 | A1 | 10/2010 |
| WO | 2012131097 | A1 | 4/2012 |
| WO | 2015049066 | A1 | 4/2015 |
| WO | 2015049066 | A1 | 9/2015 |
| WO | 2017178665 | A1 | 10/2017 |

* cited by examiner

CLOSURE DEVICE WITH OPENING INDICATOR

CROSS-REFERENCE TO RELATED APPLICATIONS

This application is a 371 PCT national application claiming priority to PCT/ES2016/070254, filed Apr. 13, 2016, having the same title, and having the same inventor, and which is incorporated herein in by reference in its entirety.

DESCRIPTION

Object of the Invention

The present invention relates to the field of container closures and particularly to a closure device indicating that the container has been opened at least once.

Background of the Invention

There are many circumstances in which it is important to know whether a container or package has been previously opened. This is the case, for example, of containers whose content degrades after the first opening, containers under suspicion of having been adulterated or manipulated for illegal purposes, or just to guarantee consumers that the content of products in general is intact at the time of purchase. In the particular case of closures, various techniques have been developed based on plastic parts that are broken off, detached or change position after a first opening of the container.

For example, EP 1892194 A1 discloses a closure device comprising a base attached to the container and a lid hinged to the base that partially covers it. The device comprises a first opening indicator attached to the lid by separable connections, which is visible previous to its opening. During the first opening, the stresses performed result in breakage of the connections, so the first opening indicator falls into a housing of the base and is hidden from view of the user. While a user who is familiar with the device may realise that the absence of the indicator means that the package has been opened, a user who has not previously seen the package is likely to overlook this change.

U.S. Pat. No. 4,941,592 A shows a second example with a similar technology. In this case, the dispensing device comprises two tabs attached to the lid, which are separated during the first opening, being hidden in respective housings of the base. The tabs are located on both sides of the closure, separated 90° from the hinge allowing the opening thereof. Once again, if the user only sees a container that has been opened, without knowledge of its previous appearance, (s)he is likely to ignore the signs.

In short, all the above mentioned solutions have the disadvantage that the signs of opening are inconspicuous once the container is opened. Accordingly, when a user finds an open container, (s)he could overlook the signs, or may need to compare it with another still closed container, which is not always possible. Additionally, the opening signalling devices known may require significant structural changes of the product and result in complicated handling.

In the state of the art there is, therefore, the need for a closure device that allows the user to know clearly whether a container has been opened and without the comparison with other units. It is also desirable that the device does not significantly change the container nor relevantly complicate its initial opening, and that the signs be robust and unable to accidentally fall off the container after opening.

DESCRIPTION OF THE INVENTION

The present invention solves the problems described above by means of a closure device that allows a clear visualisation of a detached opening indicator after a first opening.

In a first aspect of the invention, a closure device is provided comprising:

- A base that is fixed to the outside of a neck of a container by means of a first peripheral wall. The first peripheral wall has mainly rotational symmetry around a longitudinal axis.
- A lid hinged to the base by a hinge or articulation element, allowing, therefore, relative movements between the base and the lid from a closed position to an open position.
- At least one opening indicator, that before the first opening remains attached to the lid and at least partially visible to the user. Said opening indicator is located in a position, which is diametrically opposite to the hinge with respect to the longitudinal axis. The attachment between the lid and the opening indicator is performed by one or more separable connectors, so that when the lid moves from the closed position to the open position for the first time, the stresses induced on the separable connectors cause their breakage and the detachment of the opening indicator.
- At least one housing that receives and stores the at least one opening indicator after the breakage of the separable connectors. The housing comprises an upper slot and one or more windows that allow the user to clearly see the indicator and determine whether the container has been opened. The remainder of the housing is sealed by walls, typically of the same material as the rest of the base.

Preferably, the opening indicator is a band with an extended protrusion in radial direction relative to the longitudinal axis. The geometry and size of the protrusion allows for both the partial insertion of the band into the housing through the upper slot and the prevention of its removal once introduced. More preferably, the band is connected to the lid by three equally spaced attachment points. Also preferably, the housing and/or the opening indicator are made of a plastic material which allows sufficient deformation to partially introduce said indicator into the housing during installation or manufacture of the device and to prevent its subsequent accidental removal.

Preferably, the housing comprises two windows distributed along the perimeter surface of the base in the area occupied by the opening indicator, being separated by a reinforcing structure. The visibility of the indicator is thus maximised after the first opening of the container, at the same time as ensuring that the indicator is not accidentally expelled through the windows.

Preferably, the attachment between the lid and the base may be reinforced by auxiliary fixing means distributed peripherally, thus ensuring that both elements remain attached despite the movements performed by the hinge. Also preferably, the contact plane between the base and the lid is perpendicular to the longitudinal axis.

Preferably, the device comprises additional means to enhance the fastening to the container neck, such as an inner thread and/or a second peripheral wall that is fixed inside said neck.

To ensure that the lid can be closed properly, once broken the attachment points between said lid and the opening indicator that initially fixes it to the base, said base preferably comprises a grip which fixes the lid in the closed position after the first opening. Said grip is therefore located in a diametrically opposite position relative to the hinge axis, the grip being, in any event, easily removable at the user's will.

Preferably, the attachment between the lid and the base in the area of the hinge is provided by a second housing wherein an extension connected to the hinge is introduced. Also, the morphology of the extension and the second housing allows the insertion of the extension during installation or manufacture of the device, but prevents its subsequent removal. That is, the connection between the lid and the base in the area of the hinge remains fixed regardless of the opening of the device.

In a second aspect of the invention, a method for manufacturing a closure device is provided comprising:

Molding a lid with a hinge and at least one opening indicator at opposite ends. The opening indicator is attached to the lid by at least one separable connector adapted to be separated from the lid after a first opening.

Molding a base with a first peripheral wall adapted to be outwardly fixed to a neck of a container, and at least a first housing and a second housing at diametrically opposite ends. The first housing is located in a position, which is diametrically opposite to the hinge, and comprises one or more windows.

Introducing a lower end of the opening indicator into an upper slot of the first housing, and an extension of the hinge into the second housing.

Preferably, the steps of molding the base and molding the lid are made by injection of plastic material. Note that the materials of the base and the lid may be identical or different. Note also that the method of the invention may comprise molding the lid and/or the base with any of the preferred options and particular modes for carrying out the invention described for the device of the invention.

In short, the device described allows the user to know whether the container has been previously opened clearly and without the need to compare with other states of the container and/or other similar containers. Said information is provided to the user without hindering the initial opening of the device and without substantially changing the morphology or appearance of the container. In addition, the visibility of the opening indicator is maximised while its integrity is guaranteed. Finally, the closure device is easily manufactured and installable and can be made by molding of plastic materials in only two pieces. These and other advantages of the invention will be apparent in the light of its detailed description.

DESCRIPTION OF THE DRAWINGS

In order to assist in a better understanding of the characteristics of the invention according to a preferred exemplary mode for carrying it out and to complement this description, the following figures, of illustrative and not limiting nature, are attached.

PREFERRED MODE FOR CARRYING OUT THE INVENTION

In this text the word "comprises" and its derivations (such as "comprising", etc.) should not be understood in an excluding sense, that is, these terms should not be interpreted as excluding the possibility that what is described and defined can include further elements, steps, etc.

For better clarity of the description of the preferred modes for carrying out the invention herein will be named "front" the part of the device in which the tamper band is located and, therefore, said tamper band is in direct face to face view. Similarly, herein will be named "back" the part of the device in which the hinge is located and, therefore, said hinge is in direct face to face view.

Figure 1:
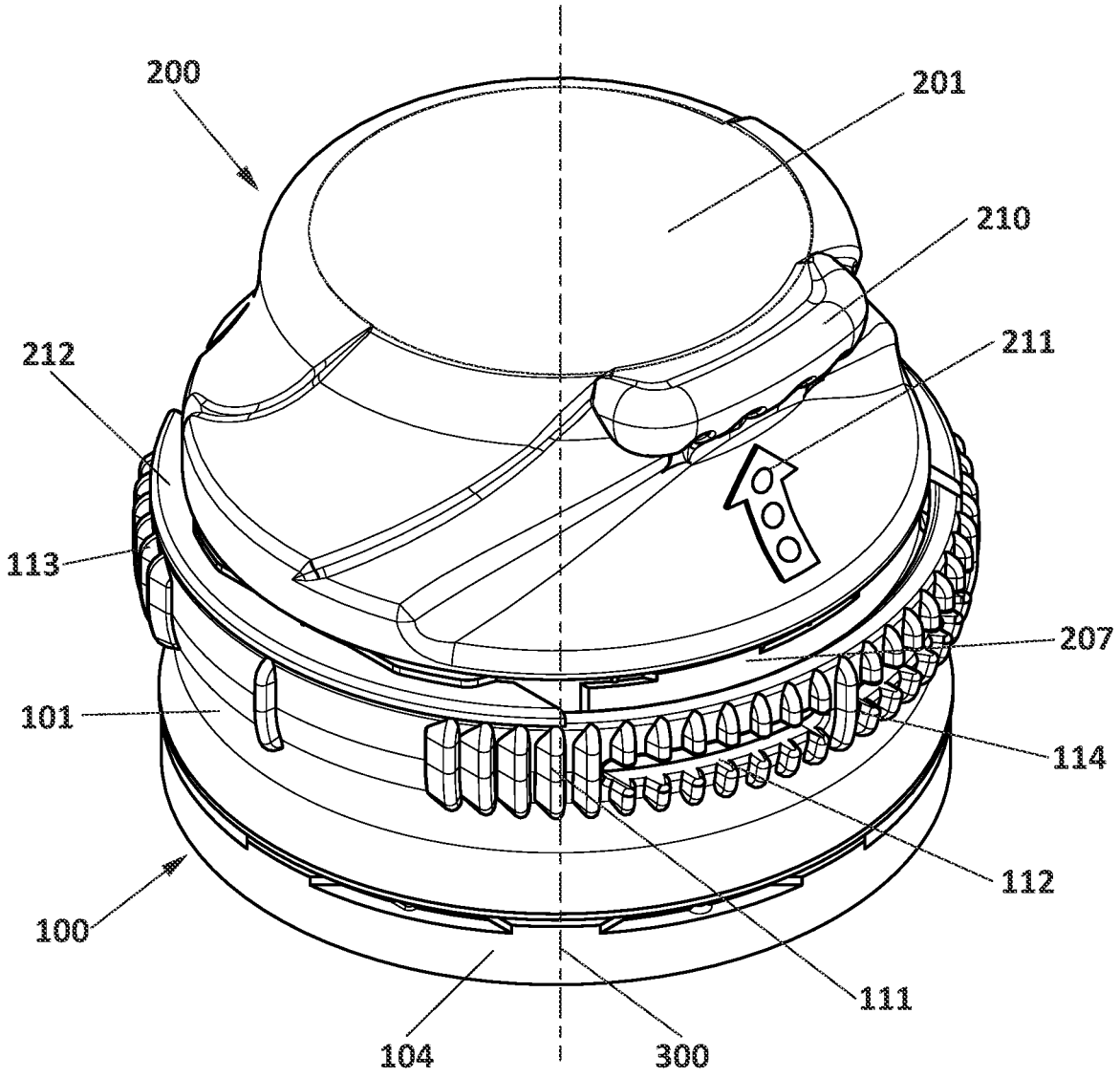
FIG. 1 is a first perspective view of the closure device prior to the first opening, according to a preferred embodiment.

FIG. 1 shows a first perspective view of a preferred mode for carrying out the invention of the closure device wherein can be seen the front thereof prior to the first opening. The device comprises a base 100 and a lid 200, typically made by molding a plastic material. The base 100 comprises a first peripheral wall 101 adapted to surround the outside of the neck of a container. The peripheral wall 101 has rotational symmetry about a longitudinal axis 300. Note, however, that the axis 300 is only defined to facilitate the clarity of the description, so other particular modes for carrying out the peripheral wall 101 can be implemented with alternative geometries.

At its upper front end, the base 100 comprises a first housing 111 with two windows 112 in which an opening indicator 207 is housed after the device is opened for the first time. These windows 112 are separated by a partition 114 or reinforcing structure. Additionally, the base 100 comprises a strip 104 at the lower end of said first peripheral wall 101 which acts as a safety ring. The strip 104 is attached to the lower end of the first peripheral wall 101 by detachable joints 105. Furthermore, said base 100 comprises a plurality of peripherally distributed projections 113 at the upper end of the first peripheral wall 101.

The lid 200 comprises a top cover 201 which prevents the exit of the content stored in the container, a loop 210 to facilitate opening of said lid 200, and a guiding element 211 in relief indicating the opening direction. The lid 200 further comprises auxiliary fixing means 212 that are introduced into the upper perimeter of the base 100 to maintain the attachment of the device during opening. The auxiliary attachment means may be initially separated from the upper cover 201, or be attached to said upper cover 201 by attachments that are easily broken during the first opening of the device.

Finally, the lid 200 comprises an opening indicator 207, whose lower end is partially introduced into an upper opening of the first housing 111 of the base 100 during manufacture or installation of the device. Said opening indicator 207 is a band covering an arc of circumference of attachment between the lid 200 and the base 100, initially attached to the lid 200 by a plurality of separable connectors 209. Note that prior to the first opening, the opening indicator is not visible through the windows 112. Note also that the band may comprise any element or additional feature that enhances its visibility once the device is open, such as text or a distinct colour to the first housing 111.

Figure 2:
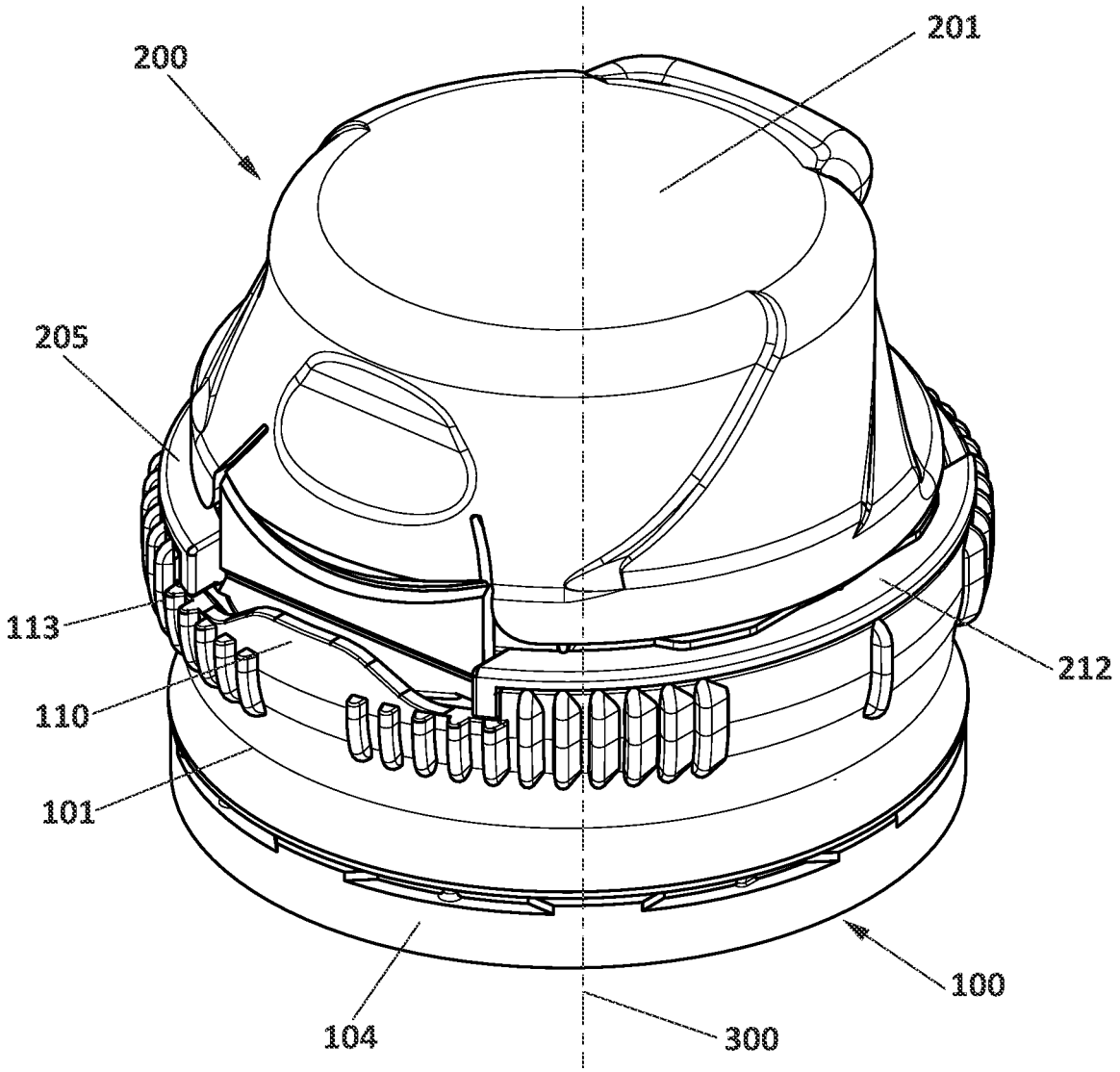
FIG. 2 is a second perspective view of the closure device prior to the first opening, according to the preferred embodiment.

FIG. 2 shows a second perspective view of the same preferred embodiment of the device before the first opening, in this case showing the back of the device. There can be seen the hinge 205 mounted on the body of the lid 200 and the attachment between the auxiliary fixing means 212 and the lower end of said hinge 205. Note that in the present description, hinge 205 means anything that allows articulation of the base 100 and the lid 200, facilitating the relative movement of both elements between a closed position and an open position, and maintaining a point of attachment between the base 100 and the lid 200 throughout the entire process. For example, depending on particular modes for carrying out the invention, the hinge 205 may be a region of the lid in which one or more partial slots are made that allow its articulation, or it may be a separate element connected to the base 100 and the lid 200 by any conventional mechanical technology known in the state of the art.

Figure 3:
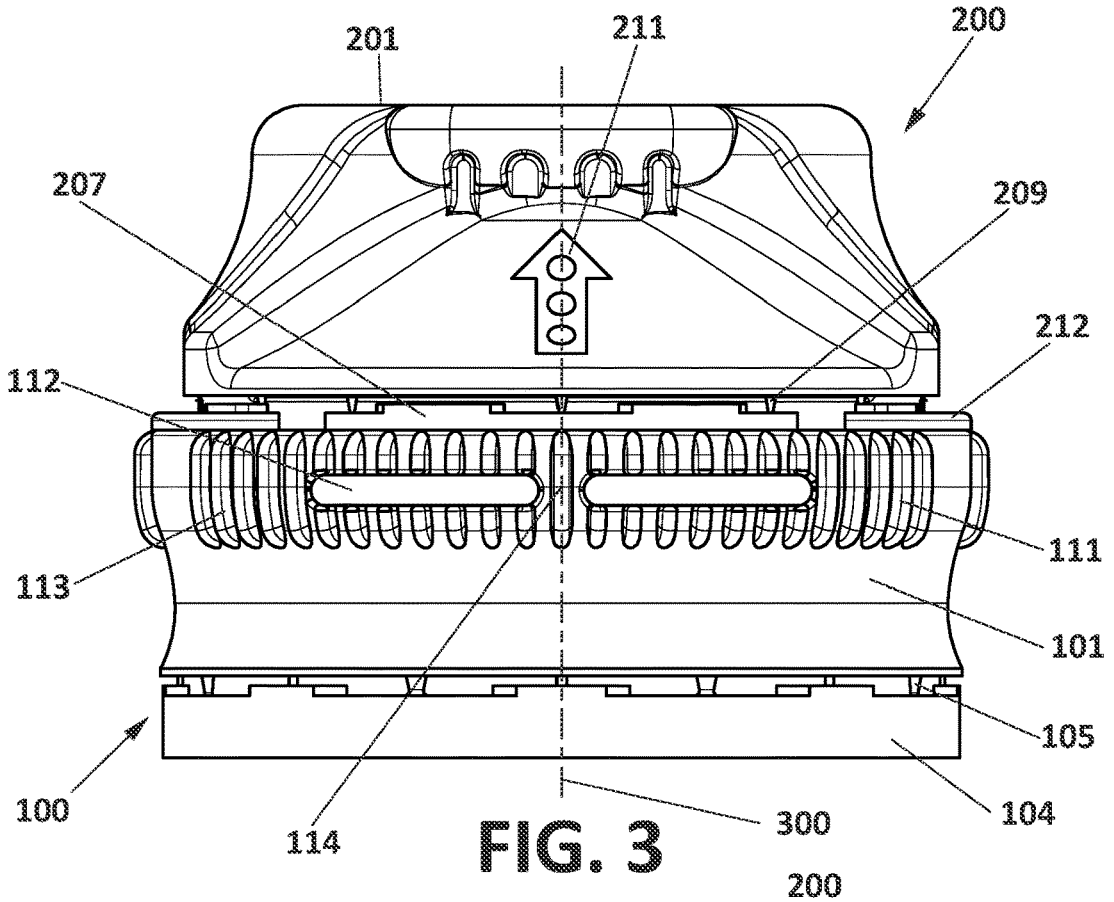
FIG. 3 is a frontal view of the closure device prior to the first opening, according to the preferred embodiment.

FIG. 3 is a front view of the same implementation of the closure device described. Note in particular the presence of three separable connectors 209 equidistant between the upper end of the opening indicator 207 and the rest of the lid 200 and detachable joints 105 between the strip 104 and the first peripheral wall 101. The separable connectors 209 are joints of the same plastic material used to implement the lid 200 and the opening indicator 207, but its thickness is so reduced that the stresses caused by the first opening of the device result in its breakage, separating the lid 200 and the opening indicator 207.

Figure 4:
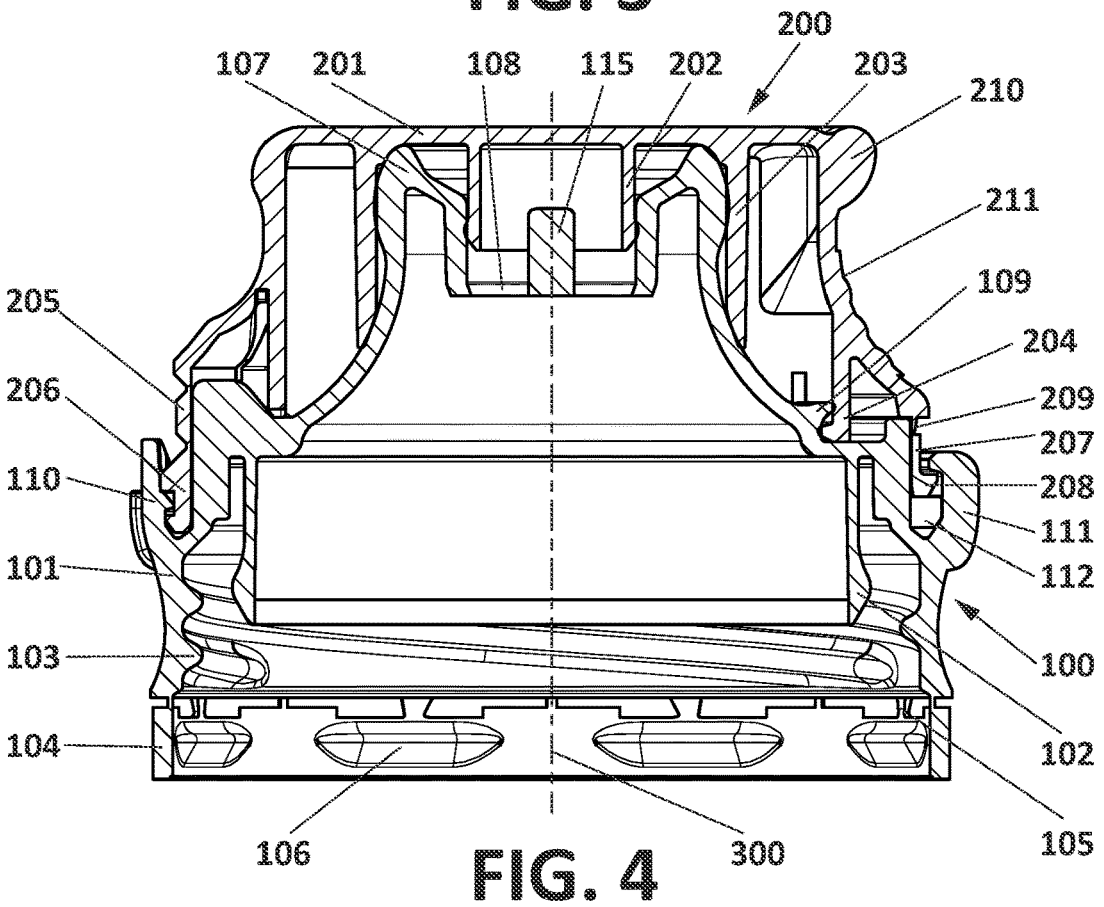
FIG. 4 is a sectional view of the closure device prior to the first opening, according to the preferred embodiment.

FIG. 4 presents a section of the same embodiment of the closure device on a plane that contains the centre of the hinge 205, the axis 300 and the centre of the opening indicator 207, allowing the internal characteristics of the device and the different attachments between the lid 200 and the base 100 to be seen. Relative to the interior of the base 100, the first peripheral wall 101 comprises in its interior a thread 103 adapted to screw on an additional screw on the outside of the neck of the container. The lower strip 104 comprises, in addition, a plurality of protuberances 106 distributed along its inner perimeter. Furthermore, the base 100 comprises a second peripheral wall 102, concentric to the first peripheral wall 101 and of smaller diameter, which rests on the inner side of the neck, reinforcing the fastening to the container and directing the content of the container towards a nozzle 107, which in this case, stands out from the rest of the base 100. The nozzle 107 comprises one or more openings 108 and a dispenser 115 that controls the output of liquid.

With regards to the lid 200 it comprises a third peripheral wall 203, concentric to the second peripheral wall 102 and of smaller diameter, adapted to cover the exterior of the nozzle 107; and a fourth peripheral wall 202, concentric to the third peripheral wall 203 and of smaller diameter, adapted to cover the interior of the nozzle 107, thus preventing the exit of the content of the container while the closure device is closed.

At the lower front end of the nozzle 107 a protuberance or grip 109 is located, which cooperates with a latch 204 on the inner bottom front end of the lid 200 to keep the lid 200 closed at the user's will, even after the opening indicator 207 has been detached. Note that said latch 204 is not fixed, but can be opened by the user easily by applying pressure upwards in the lid 200, for example by pulling the loop 210. At the end, which is diametrically opposite to said loop 109 with respect to the axis 300, the fixation of the hinge 205 and the base 100 is carried out. Such fixation is permanent, i.e., it is maintained both in an open and a closed position, and is made through introduction of a hinge 205 extension 206 into a second housing 110. Both the extension 206 and the second housing 110 comprise wedge shaped protuberances that allow for the introduction of the elements but not their removal.

Equivalently, the opening indicator 207 comprises a protuberance 208, which protrudes in radial direction with respect to the axis 300. The lower side of the protuberance 208 is, at least in part, wedge-shaped, while the upper side of the protuberance 208 is mostly flat. Thanks to this morphology, the opening indicator 207 can be introduced into the first housing 111 during installation or manufacture of the device, while the removal of said opening indicator 207 during the operation of the device is prevented.

Figure 5:
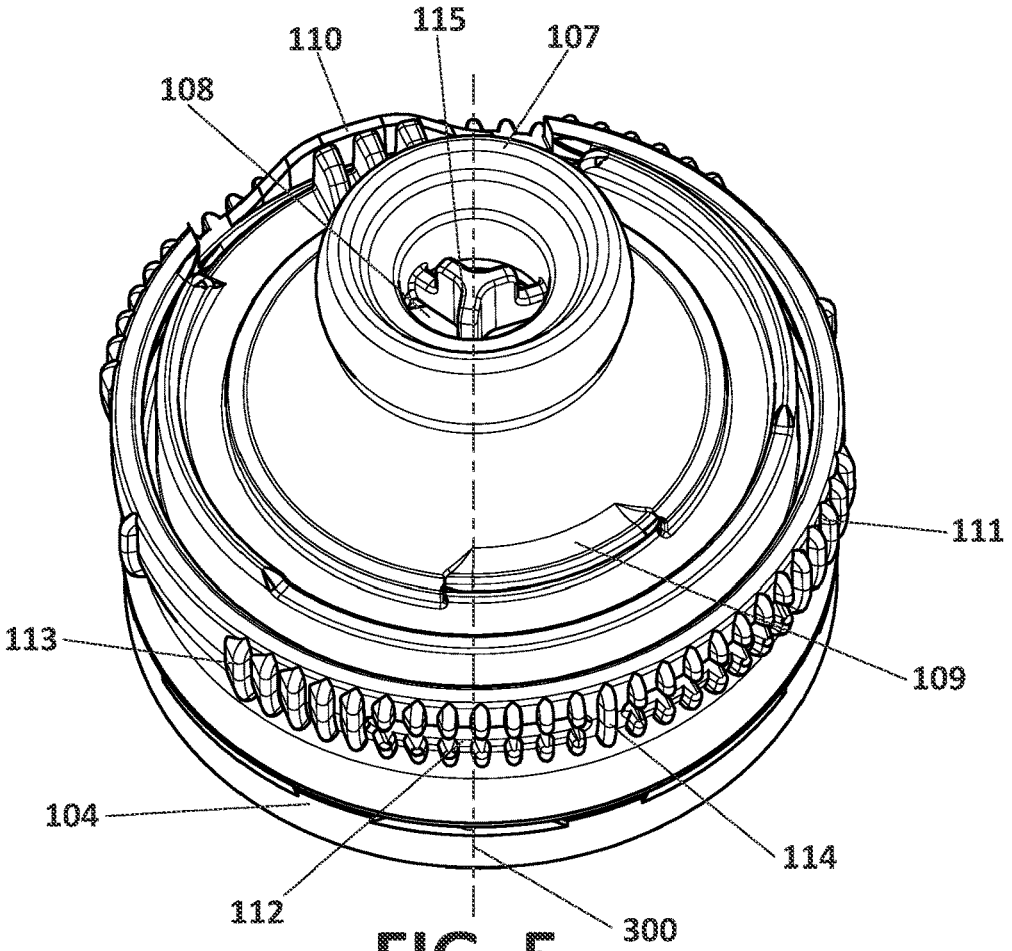
FIG. 5 is a perspective view of the base of the closure device, according to the preferred embodiment.
Figure 6:
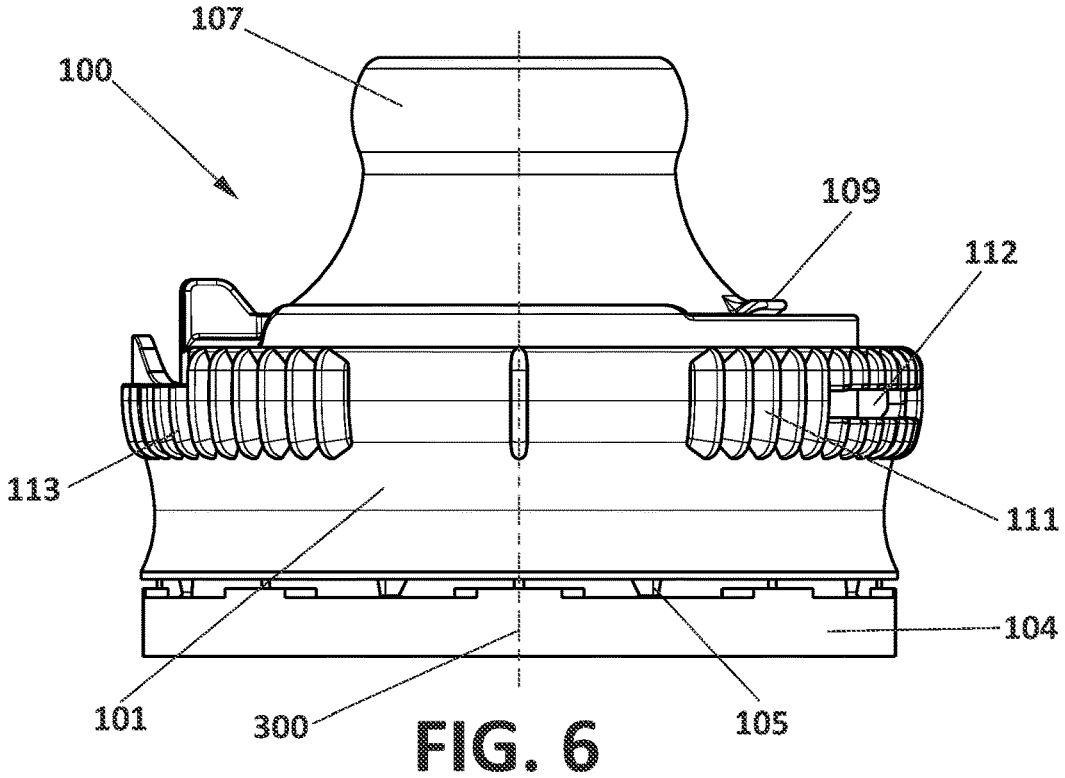
FIG. 6 is a side view of the base of the closure device, according to the preferred embodiment.
Figure 7:
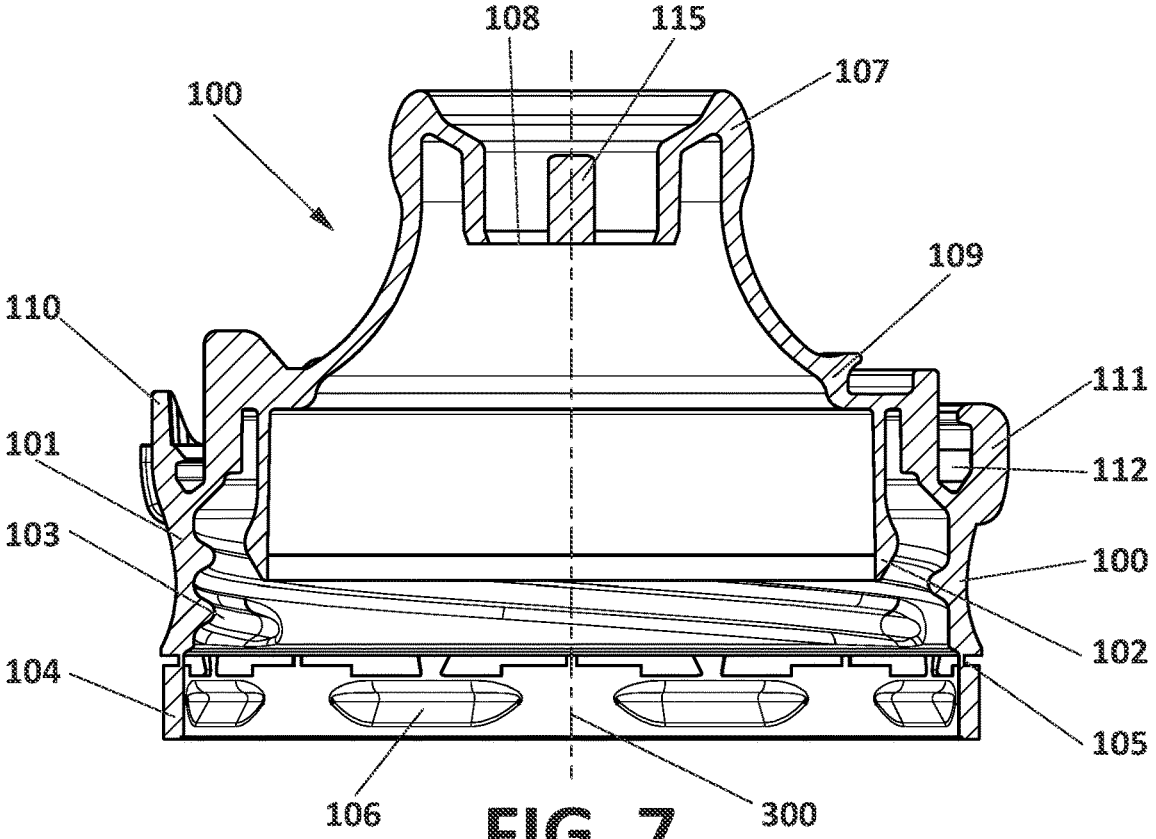
FIG. 7 is a sectional view of the base of the closure device, according to the preferred embodiment.
Figure 8:
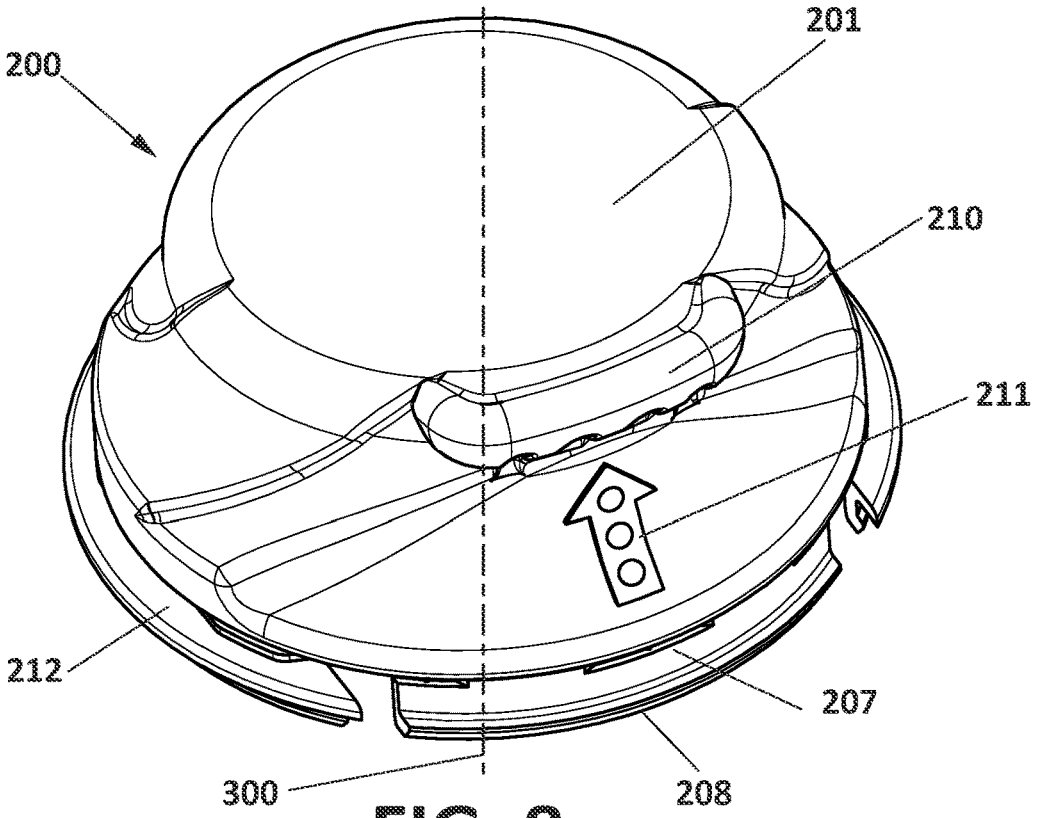
FIG. 8 is a perspective view of the lid of the closure device, according to the preferred embodiment.
Figure 9:
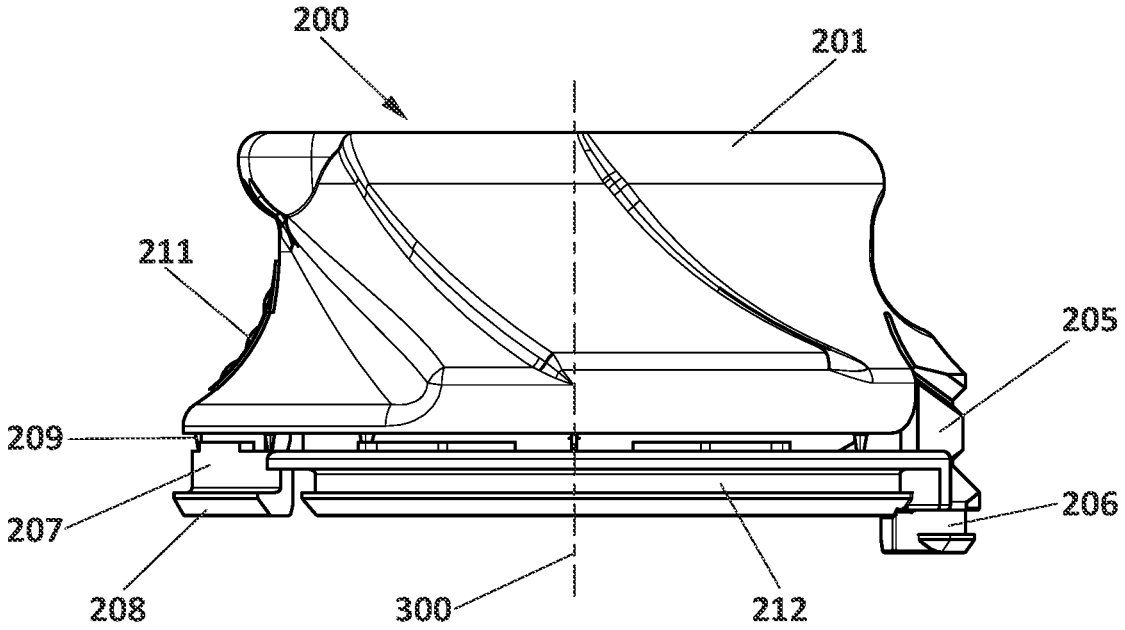
FIG. 9 is a side view of the lid of the closure device, according to the preferred embodiment.
Figure 10:
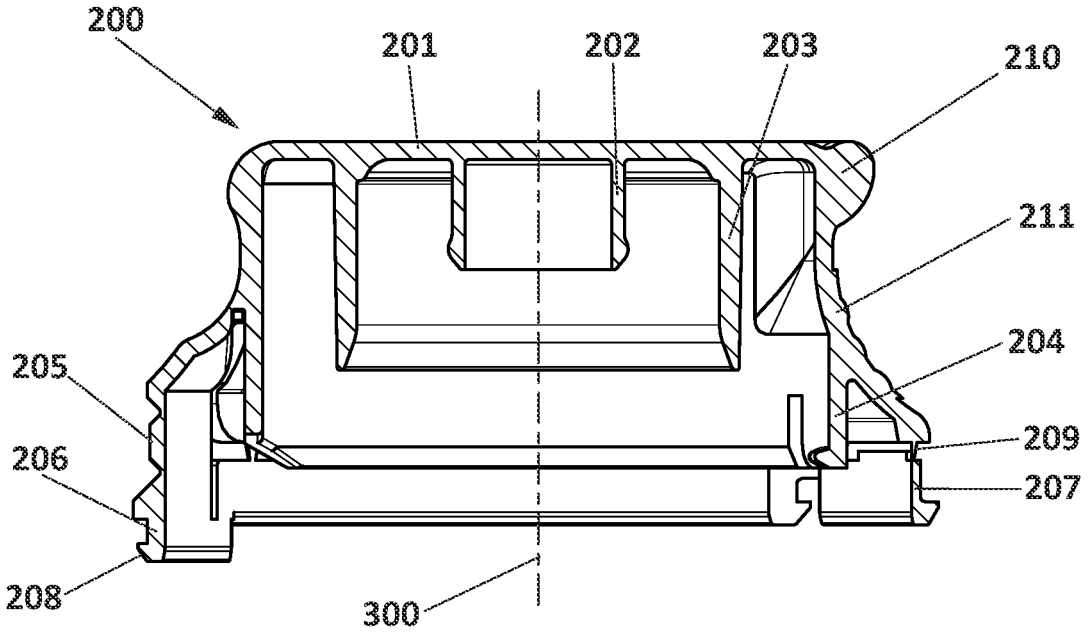
FIG. 10 is a sectional view of the lid of the closure device, according to the preferred embodiment.

All elements and features of the described preferred embodiment can be seen in greater detail in FIGS. 5 to 10, which present the base 100 and the lid 200 separately. In particular, FIG. 5 is a perspective view of the front of the base 100, FIG. 6 is a side view of the base 100 and FIG. 7 is a sectional view of the base 100 in the same cutting plane of the FIG. 4. On the other hand, FIG. 8 is a perspective view of the front of the base 200, FIG. 9 is a side view of the base 200 and FIG. 10 is a sectional view of the base 200 in the same cutting plane of the FIG. 4.

Figure 11:
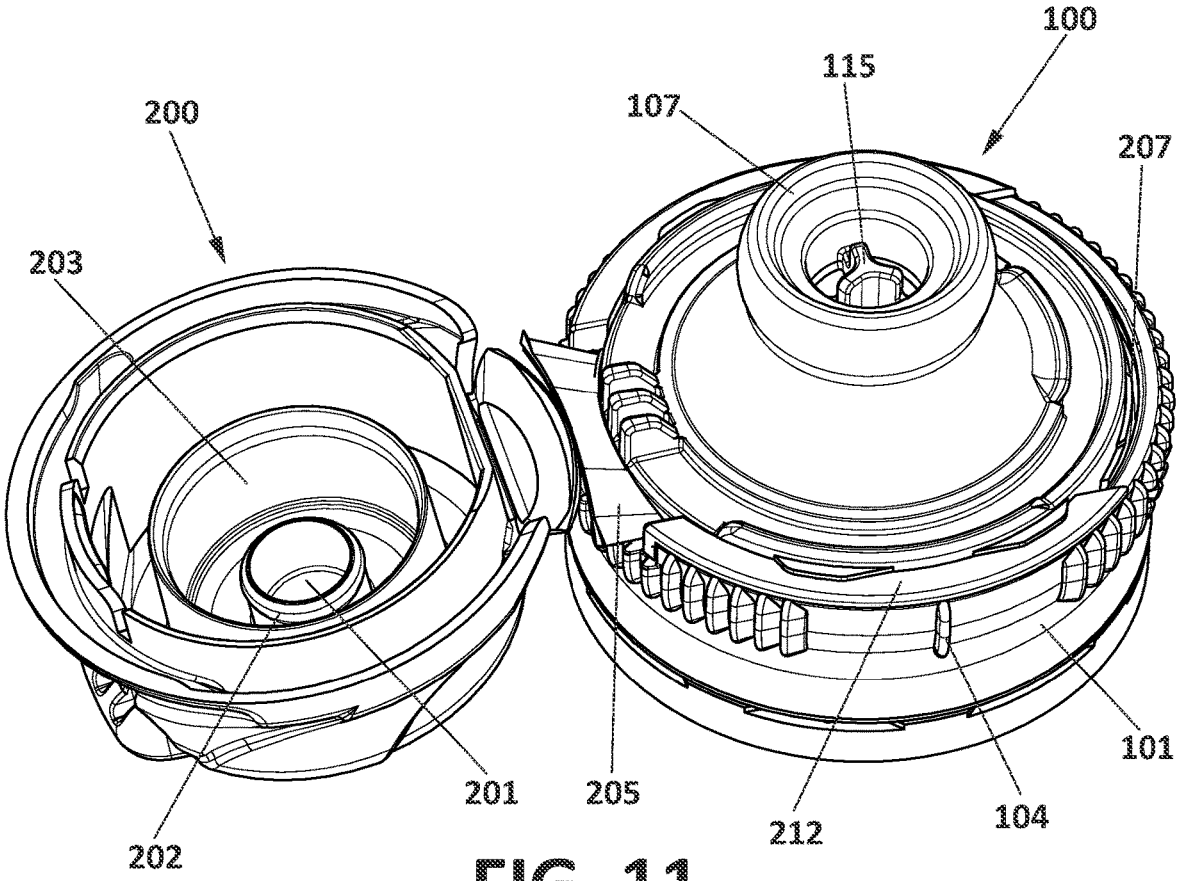
FIG. 11 is a perspective view of the closure device open, according to the preferred embodiment.

FIG. 11 shows the state of the same embodiment of the closing device after a first opening thereof. Due to the stress exerted to open the lid 200, the separable connectors 209 are broken, shedding the opening indicator 207. Said opening indicator 207 is received by the first housing 111, being visible to the user through the windows 112. The separation or reinforcing structure 114, the size of the windows 112 and the protuberance 208 of the opening indicator 207 ensure that said opening indicator 207 does not leave the first housing 111 regardless of subsequent movements of the container and the closure device.

Figure 12:
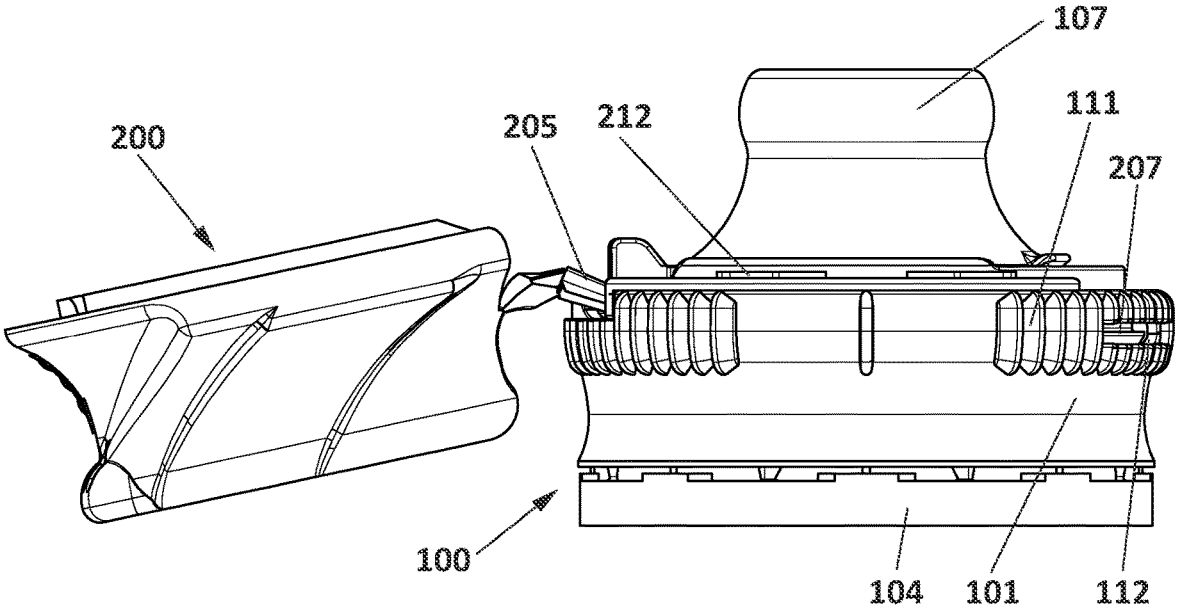
FIG. 12 is a side view of the closure device open, according to the preferred embodiment.
Figure 13:
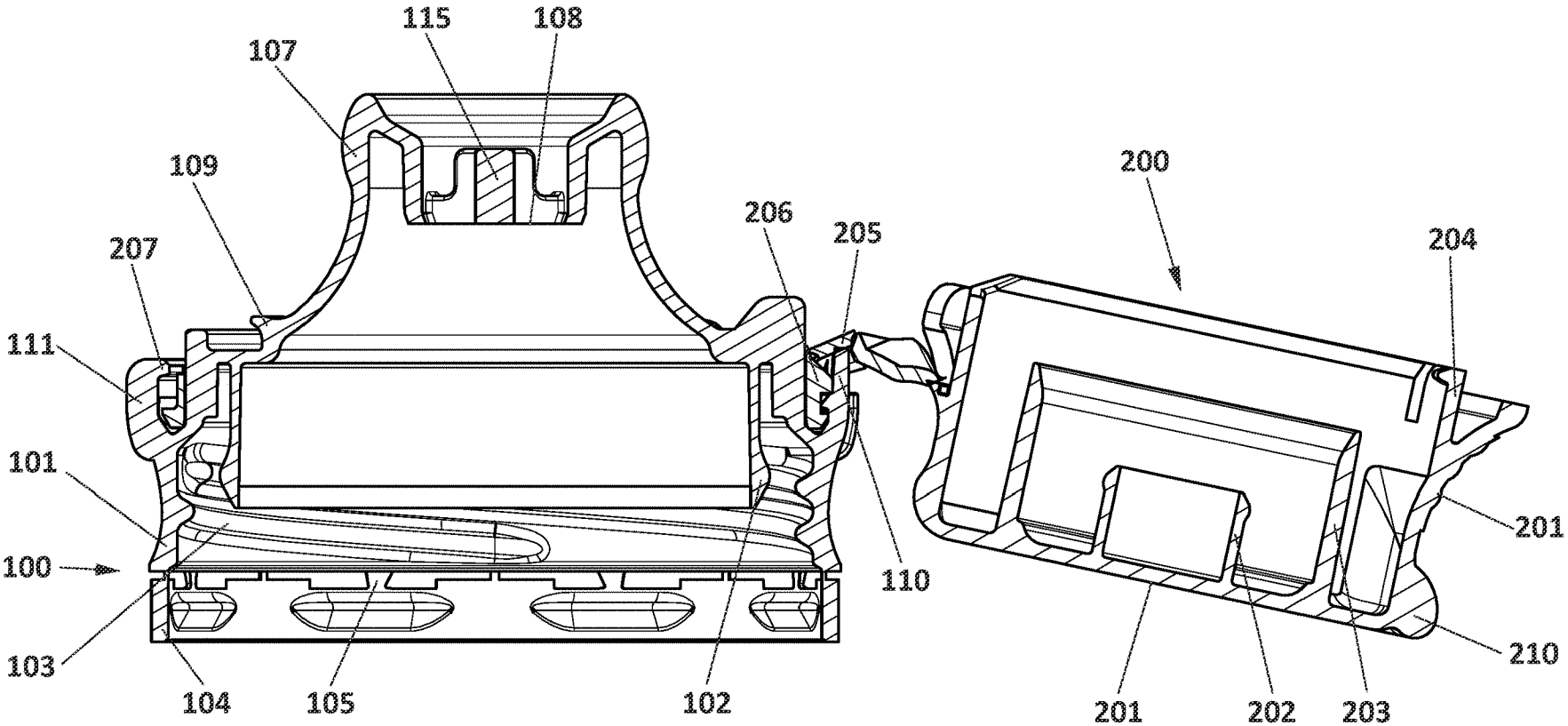
FIG. 13 is a sectional view of the closure device open, according to the preferred embodiment.

FIGS. 12 and 13 show, respectively, a side view and a section of the same embodiment and in the same position as in FIG. 11. Note in particular the position of the hinge 205, whose partial slots in its top and bottom ends allow the articulation of the lid 200 by deforming only the region of said slots.

Figure 14:
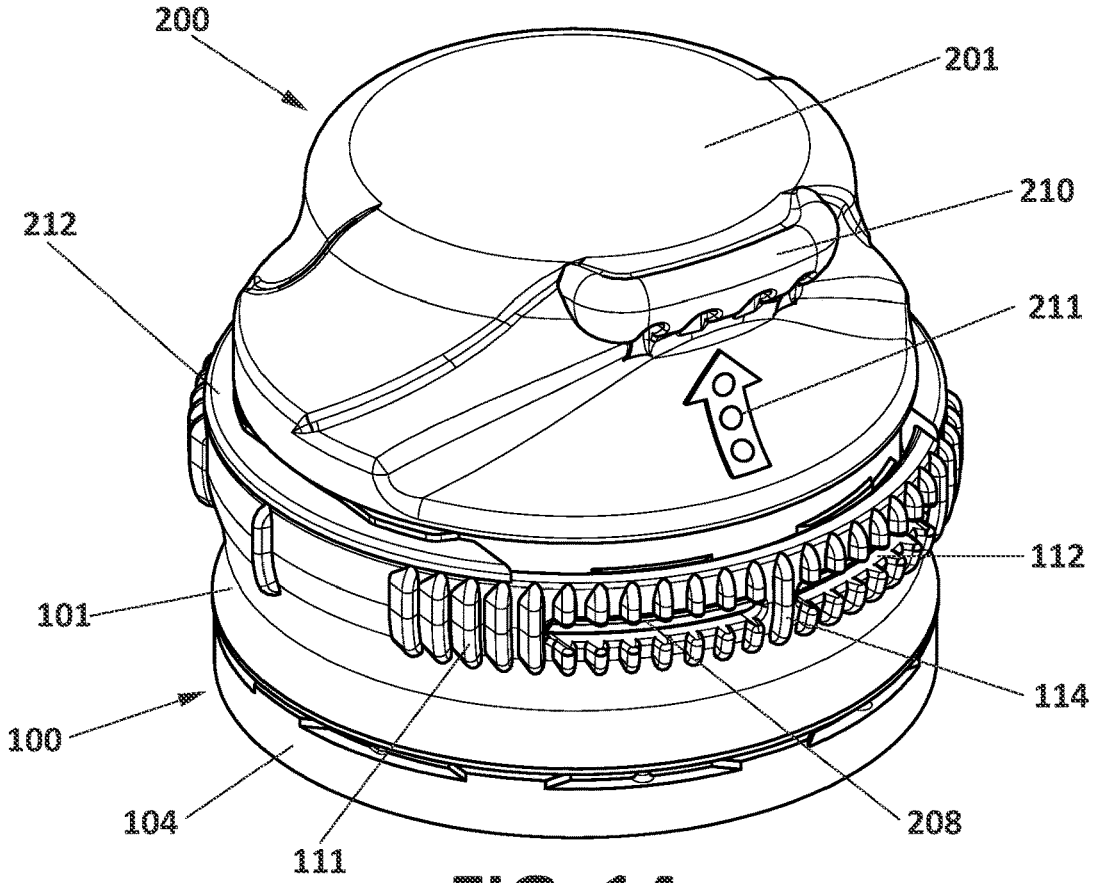
FIG. 14 is a first perspective view of the closure device, closed after a first opening, according to the preferred embodiment.

Finally, FIG. 14 shows the state of the same embodiment of the closing device after, at least, one opening and closing.

Figure 15:
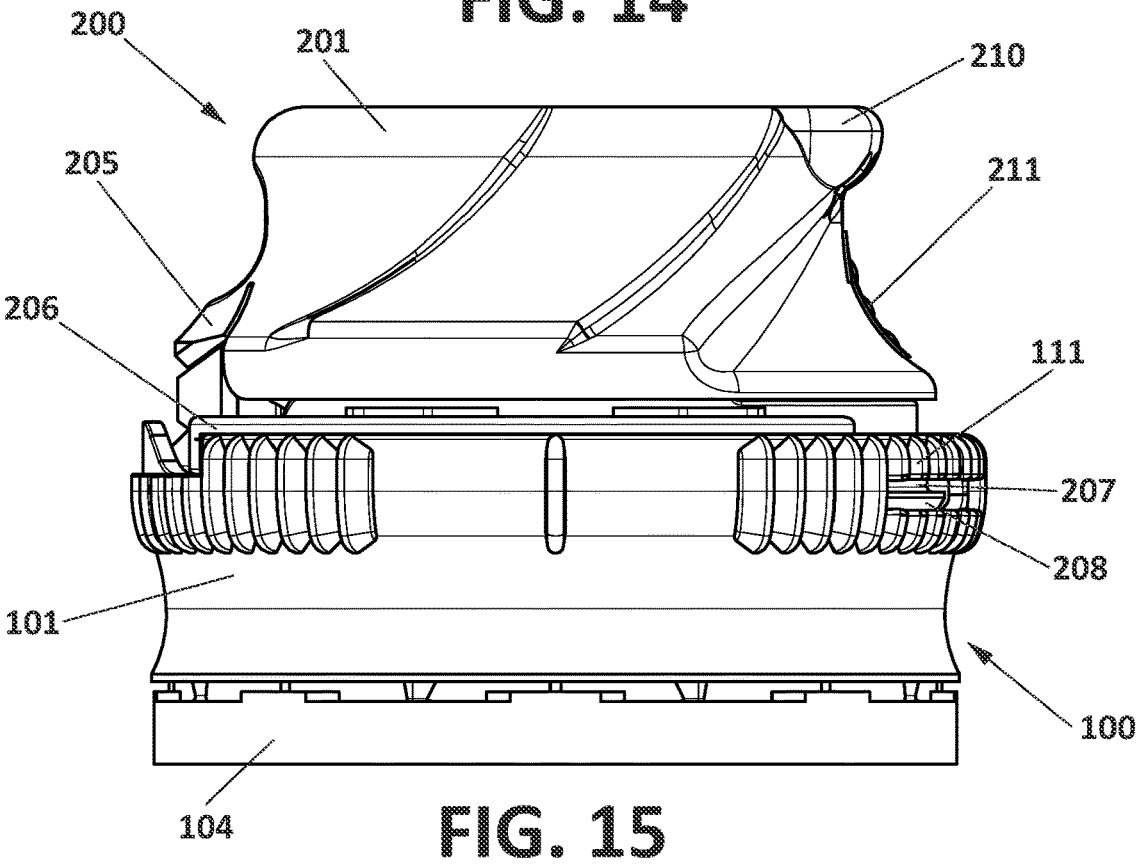
FIG. 15 is a side view of the closure device, closed after a first opening, according to the preferred embodiment.
Figure 16:
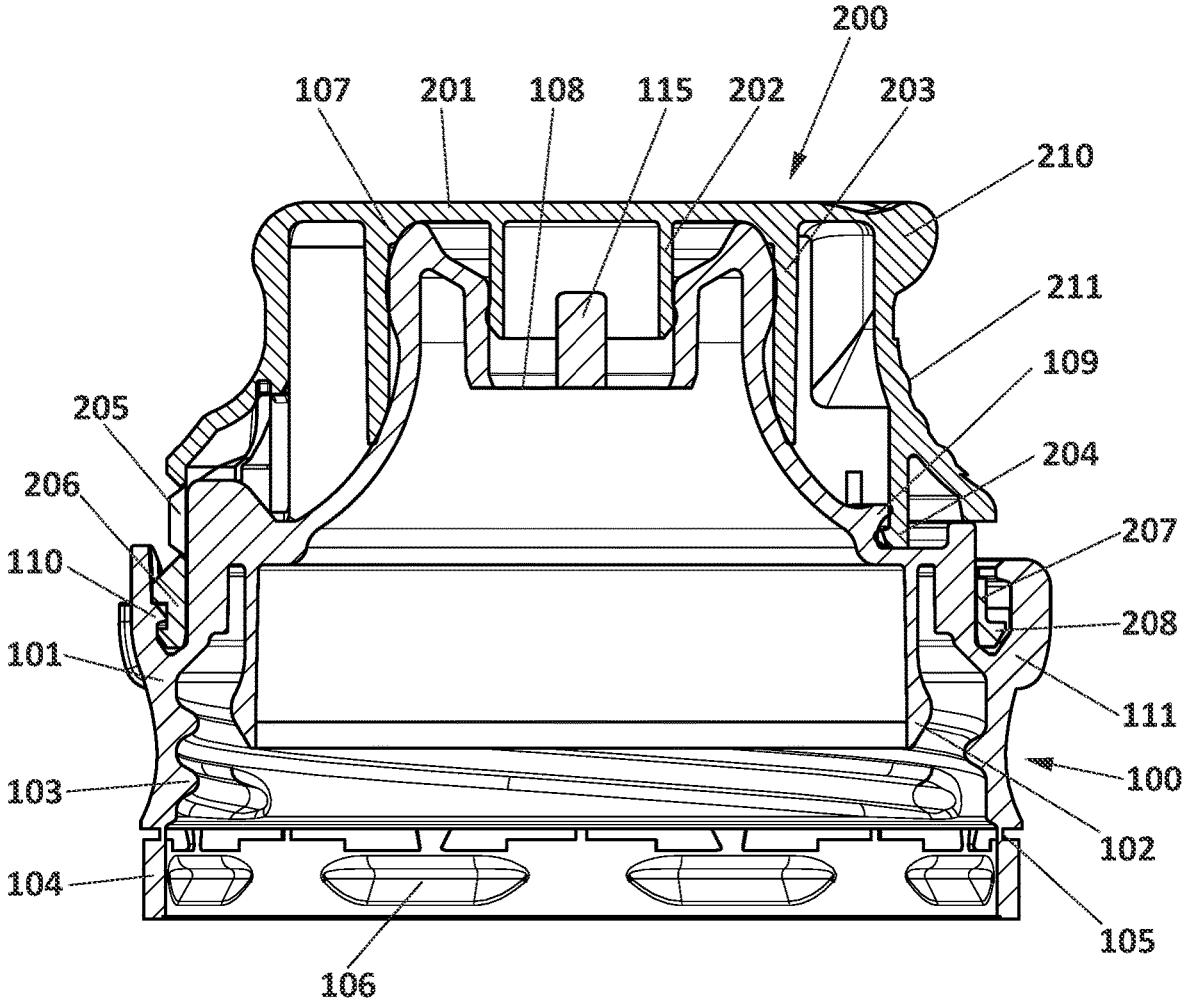
FIG. 16 is a sectional view of the closure device, closed after a first opening, according to the preferred embodiment.

FIGS. 15 and 16 show, respectively, a side view and a section of the same embodiment and in the same position as in FIG. 14.

After closing, the lid 200 returns to its original position, remaining fixed to the base 100 by the previously described connections. The only difference with respect to the initial position prior to the first opening is that the opening indicator 207 remains detached after breakage of the detachable connectors 209, said opening indicator 207 being shown through the windows 112. That is, the closure device continues to fulfil its function of keeping the contents inside the container, but the user can clearly see that the container has been opened at least once without having to compare it with other similar units. This makes for a clear, intuitive, secure and robust sign; without interfering at any time with normal operation of the closure device.

In view of this description and Figures, the person skilled in the art will understand that the invention has been described according to preferred embodiments thereof, but that multiple variations can be introduced in said preferred embodiments without departing from the object of the invention as has been claimed. For example, an embodiment has been presented in two parts with the articulation element integrated at the top. However, other embodiments may implement the functions described by a larger number of pieces connected together, or with alternative distributions of functionality between the two pieces, such as integrating the articulation element at the base. Similarly, the base and/or lid may have different morphologies to adapt to the morphology of the container to be covered, always maintaining the elements and functionalities claimed.

The invention claimed is:

1. A closing device comprising:

a base (100) with a first peripheral wall (101) adapted to be fixed externally to a neck of a container, said first peripheral wall (101) defining a central longitudinal axis (300);

a lid (200) hingedly connected to the base (100) by way of a hinge (205);

at least one opening indicator (207) connected to the lid (200) by at least one separable connector (209) prior to a first opening thereof, said opening indicator (207) being separated from the lid (200) after said first opening; and at least one first housing (111) with at least one window (112), the first housing (111) disposed in a position diametrically opposite the hinge (205) with respect to the axis (300), said at least one first housing (111) receiving the at least one opening indicator (207) after the first opening and showing said at least one opening indicator (207) through the at least one window (112);

such that due to the stress exerted to open the lid (200), the at least one separable connector (209) is broken, shedding the opening indicator (207), wherein said opening indicator (207) is received by the at least one first housing (111), being visible to the user through the at least one window (112);

wherein the at least one opening indicator (207) is a band with at least one protuberance (208) in radial direction with respect to the axis (300), said protuberance (208) allowing the band to be inserted in the at least one first housing (111) and preventing the removal of said band from the at least one first housing (111);

wherein the separable connectors (209) comprise at least three attachment points equally spaced along the band; and wherein the base (100) comprises a grip (109) in a position diametrically opposite to the hinge (205) with respect to the axis (300), said grip (109) maintaining the lid (200) closed subsequent to the first opening.

2. The device according to claim 1, wherein the at least one first housing (111) comprises at least two windows (112) distributed in a peripheral direction with respect to the axis (300), the at least two windows (112) remaining separated by at least one reinforcing structure (114).

3. The device according to claim 1, wherein the lid (200) further comprises auxiliary attachment means (212) peripherally distributed with respect to the axis (300), said auxiliary attachment means (212) connecting the lid (200) to the base (100) regardless of the relative movement between said lid (200) and said base (100) caused by the hinge (205).

4. The device according to claim 1, wherein the at least one opening indicator (207) comprises a deformable plastic material which allows said at least one opening indicator (207) to be inserted into the at least one first housing (111).

5. The device according to claim 1, wherein the at least one first housing (111) comprises a plastic material which deforms to allow the insertion of the at least one opening indicator (207) into the at least one first housing (111).

6. The device according to claim 1, wherein base (100) and the lid (200) contact each other across a main plane which is perpendicular to the axis (300).

7. The device according to claim 1, wherein the first peripheral wall (101) comprises an inner thread (103).

8. The device according to claim 1, in combination with a container equipped with a neck, wherein said first peripheral wall (101) is fixed externally to the neck of the container, and further comprising a second peripheral wall (102) which is fixed inwardly to the neck of the container.

9. The device according to claim 1, wherein the base (100) comprises a second housing (110) disposed in a position diametrically opposite to the at least one first housing (111) with respect to the axis (300), wherein the lid (200) comprises an extension (206) connected to the hinge (205), and wherein the second housing (110) allows the extension (206) to be inserted and prevents the removal of said extension (206).

10. The device according to claim 1, wherein the at least one separable connector (209) is a joint comprising the same material as the at least one opening indicator (207), the joint having a thickness that causes the breakage of said joint under a lesser force than that required to remove the at least one separable connector (209) from the at least one first housing (111).

11. The device according to claim 6, characterised in that the lid (200) comprises a third peripheral wall (203), concentric to the second peripheral wall (102) and of smaller diameter, adapted to cover the exterior of the nozzle (107); and a fourth peripheral wall (202), concentric to the third peripheral wall (203) and of smaller diameter, adapted to cover the interior of a nozzle (107).

12. The device according to claim 1, characterised in that the protuberance (208) protrudes in radial direction with respect to the axis (300), wherein the lower side of the protuberance (208) is, at least in part, wedge-shaped, while the upper side of the protuberance (208) is mostly flat.

13. A closing device comprising:

a base (100) with a first peripheral wall (101) adapted to be fixed externally to a neck of a container, said first peripheral wall (101) defining a central longitudinal axis (300);

a lid (200) hingedly connected to the base (100) by way of a hinge (205);

at least one opening indicator (207) connected to the lid (200) by at least one separable connector (209) prior to a first opening thereof, said opening indicator (207) being separated from the lid (200) after said first opening; and at least one first housing (111) with at least one window (112), the first housing (111) disposed in a position diametrically opposite the hinge (205) with respect to the axis (300), said at least one first housing (111) receiving the at least one opening indicator (207) after the first opening and showing said at least one opening indicator (207) through the at least one window (112).

14. The device according to claim 13, wherein the at least one opening indicator (207) is a band equipped with at least one protuberance (208) that extends in a radial direction with respect to the axis (300), said protuberance (208) allowing the band to be inserted in the at least one first housing (111) and preventing the removal of said band from the at least one first housing (111).

15. The device according to claim 13, wherein the separable connectors (209) comprise at least three attachment points that are equally spaced along the band.

16. The device according to claim 13, wherein the base (100) comprises a grip (109) disposed in a position diametrically opposite to the hinge (205) with respect to the axis (300), said grip (109) maintaining the lid (200) closed subsequent to the first opening.

* * * * *